United States Patent [19]

Eppinger

[11] Patent Number: 4,980,527

[45] Date of Patent: Dec. 25, 1990

[54] ARC SPINNER INTERRUPTER

[75] Inventor: David P. Eppinger, Centralia, Mo.

[73] Assignee: A. B. Chance Company, Centralia, Mo.

[21] Appl. No.: 308,145

[22] Filed: Feb. 8, 1989

[51] Int. Cl.[5] ..... H01H 33/18

[52] U.S. Cl. ..... 200/147 C

[58] Field of Search ..... 200/147 R, 147 C

[56] References Cited

U.S. PATENT DOCUMENTS

| | | | |
|---|---|---|---|
| 1,914,875 | 6/1933 | Whitney et al. | 200/147 C |
| 3,274,365 | 9/1966 | Beatty | 200/147 C |
| 4,301,340 | 11/1981 | Parry | 200/147 C |
| 4,301,341 | 11/1981 | Parry | 200/147 C |
| 4,355,219 | 10/1982 | Parry | 200/147 C |
| 4,355,220 | 10/1982 | Parry | 200/147 C |
| 4,409,446 | 10/1983 | Parry | 200/147 C |
| 4,445,017 | 4/1984 | Stewart et al. | 200/147 C |
| 4,463,230 | 7/1984 | Perrenoud | 200/147 C |
| 4,503,302 | 3/1985 | Chrisp | 200/147 C |
| 4,743,719 | 5/1988 | Spooner | 200/147 C |
| 4,748,302 | 5/1988 | Spooner | 200/147 C |
| 4,752,659 | 6/1981 | Spooner | 200/147 C |

OTHER PUBLICATIONS

"Rotating Arc Driven by Magnetic Flux in SFG Gas", by Kazushi Fujiwara et al., presented at Second International Symposium on Switching Arc Phenomena, Lodz, Poland,—Sep. 25-27, 1973.

*Primary Examiner*—Robert S. Macon

*Attorney, Agent, or Firm*—Hovey, Williams, Timmons & Collins

[57] ABSTRACT

An arc spinner interrupter includes a first fixed electrical contact and a ring electrode coupled to the fixed contact through a field coil surrounding the ring electrode. A second electrical contact has an arm which moves along a path perpendicular to the central longitudinal axis for selective connection with the fixed contact. The arm may have a generally L-shaped configuration including an angled portion that extends in a direction parallel to the central longitudinal axis. The fixed electrical contact is disposed radially outward of the ring electrode so that the generally L-shaped end of the second contact moves generally toward the central longitudinal axis when disconnected from the fixed electrical contact. During movement of the second contact away from the fixed contact, electromagnetic forces are simultaneously exerted on the arc due to the general L-shape of the arm of the second contact and move the arc material both toward the ring electrode and in the direction in which the arc spins once it has commuted to the ring electrode.

19 Claims, 2 Drawing Sheets

8.
16
14
56
52
72
44
Fc'
76
36
I1
12
34
30
33
I in
22
24
Iout
20
10
26
18

10
22
24
18
20
Iout
28
26
68
64
13
F2
72
36
76
44
I2
D2
60
D1
66
62
58
70
16
54

6.
16
14
56
52
72
44
Fc
76
36
I1
12
34
30
33
I in
22
24
Iout
20
10
26
18

10
22
24
18
20
Iout
28
26
68
64
13
F2
72
36
76
44
I2
60
66
62
58
56
70
16
54

ARC SPINNER INTERRUPTER

BACKGROUND OF THE INVENTION

1. Field of the Invention

The present invention relates generally to electrical arc interrupter devices and, more particularly, to an arc spinner interrupter having improved movable contact structure which is cooperable with a ring electrode to more efficiently extinguish an arc by decreasing the time required to initiate and effect spinning of the arc through a cool interrupting gas.

2. Discussion of the Prior Art

Numerous conventional constructions exist for providing arc interruption through the use of a field coil that creates a magnetic field in which an arc is extinguished. For example, it is known to provide an arc interruption device in which an arcing ring is electrically connected in series with a movable contact through a field coil surrounding the ring, and a fixed contact is disposed internally of the ring electrode at a point along the central axis of the electrode. In this known construction, the movable contact is mounted for pivotal movement about an axis extending in a direction perpendicular to and offset from the central longitudinal axis of the ring electrode such that the movable contact is movable between a first engaged position radially inward of the ring electrode to a second disengaged position radially outward of the ring electrode.

When the movable contact of this known device is pivoted away from the fixed contact, an arc initially forms between the movable contact and the fixed contact which is retained between these contacts until the movable contact passes over and across the ring electrode. Thereafter, the arc is transferred to the ring electrode and is spun by the action of magnetic forces created within the ring electrode by the current flow through the field coil. This spinning action within the ring electrode eventually extinguishes the arc after the arc commutes to the ring electrode. However, because the arc is carried between the movable contact and the fixed contact during a substantial portion of the travel time of the movable contact between the fixed contact and the ring electrode, an unavoidable delay in the overall quenching time of the arc occurs. Exemplary is the mechanism described by Kazushi Fujiwara, et al. of Yaskawa Electric Mfg. Co., Ltd., Kitakyushu, Japan in a paper presented to the Second International Symposium on Switching Arc Phenomena held at Lodz, Poland, Sept. 25–27, 1973.

Another known type of arc interrupter construction is disclosed in U.S. Pat. Nos. 4,301,340, 4,301,341, and 4,409,446. In this known type of construction, a ring electrode is electrically connected in series with a fixed electrode through a field coil, and a movable contact, pivotal about an axis intersecting the central axis of the ring electrode and extending in a direction perpendicular thereto, moves transversely across a circular pole face of the field coil and inwardly of the axis thereof when disengaged from the fixed contact which is disposed either directly on or radially outward of the ring electrode.

In operation of this second known type of construction, after the movable contact is removed from engagement with the fixed contact, the movable contact moves into close proximity with the ring electrode such that the arc which initially forms between the movable contact and the fixed contact commutes to the ring electrode. Thus, a part of the delay encountered in the previously discussed construction is avoided. However, in the device disclosed in U.S. Pat. Nos. 4,301,340, 4,301,341, and 4,409,446, it is critical that the device be constructed with the movable contact positioned very accurately with respect to the ring electrode in order that the arc will properly commute to the ring electrode once the movable contact passes over the ring electrode. Any variation in the relative spacing of the movable contact and the ring electrode can have an adverse effect on the amount of time required for the device to extinguish an arc, thus resulting in a device which operates in an unpredictable manner. In addition, in order to direct the arc into the interior region of the ring electrode, it is essential in this second known type of construction, that the movable contact travel along a path which extends into the interior of the ring electrode. In U.S. Pat. No. 4,503,302, a third type of known arc interruption device is illustrated which is similar to the first mentioned construction above in that an arcing ring electrode is provided which is electrically connected in series with a movable contact through a field coil surrounding the ring electrode, and a fixed contact is disposed internally of the ring electrode. However, in the device shown in U.S. Pat. No. 4,503,302, the movable contact is mounted for pivotal movement about an axis extending in a direction parallel to the central axis of the ring electrode. Thus, as with the first mentioned device, the arc remains between the movable contact and the fixed contact until the movable contact has moved a substantial distance toward the ring electrode, thus retarding the time required for initiation of arc commutation.

OBJECTS AND SUMMARY OF THE INVENTION

It is advantageous to provide an arc interruption device which consistently extinguishes arcs within a relatively narrow time period shortly after disconnection of the contacts in order to permit the arc interrupter to be employed in a distribution system including other components such as fuse links, sectionalizers and the like, which rely on the timing of the arc interruption procedure in their own operation. Therefore, it is one object of the present invention to provide such a construction.

Another object of the invention is to provide an arc interrupter which is simple to construct and which allows somewhat greater tolerance limits with respect to the spacing of the different parts of the apparatus as opposed to heretofore known devices that require very close tolerances.

Further, it is an object of the present invention to provide an arc interrupter in which an arc is managed substantially from the time it forms between the contacts until it has been extinguished in order to expedite commutation and quenching of the arc.

These advantages, among others are achieved through the use of an arc interrupter apparatus constructed in accordance with the present invention. For example, in its preferred form, an arc interruption apparatus made pursuant to the invention includes a fixed electrical contact and a movable electrical contact having an arm that may be selectively engaged with the fixed contact. An arc interrupting ring electrode is associated with the contacts and has opposed ends defining a central longitudinal axis therebetween while a field coil is provided in surrounding relationship to the ring electrode. Means are provided for electrically connecting the field coil to the fixed contact so that the field coil is maintained in an energized condition.

The arm of the movable contact includes an angled portion which projects from the remaining portion of the arm toward the electrode in a direction generally parallel to the longitudinal axis of the electrode. That arm is movable across the electrode along a path perpendicular to and toward the longitudinal axis thereof when the movable contact is shifted to interrupt current flow through the contacts. An arc is generated between the movable contact and the fixed contact when the movable contact in an energized condition is disconnected from the fixed contact. The arm cooperates with the remaining portion of the angled portion of the movable contact to cause first and second electromagnetic forces to be exerted on the arc upon disconnection of the contacts as the arm approaches the electrode and moves across the electrode. The first electromagnetic force acts in a direction toward the ring electrode so as to encourage commutation of the arc from the fixed contact to the ring with little regard to the distance of the movable contact from the ring electrode. The second electromagnetic force acts in a circumferential direction relative to the central axis of the electrode to enhance spinning and therefore extinguishment of the arc.

In a further preferred form, the movable contact of the arc interrupter apparatus is mounted for pivotal movement about a pivot axis extending in a direction parallel to the central longitudinal axis of the ring electrode, and includes a portion disposed generally in a plane perpendicular to the central longitudinal axis.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figure 1:
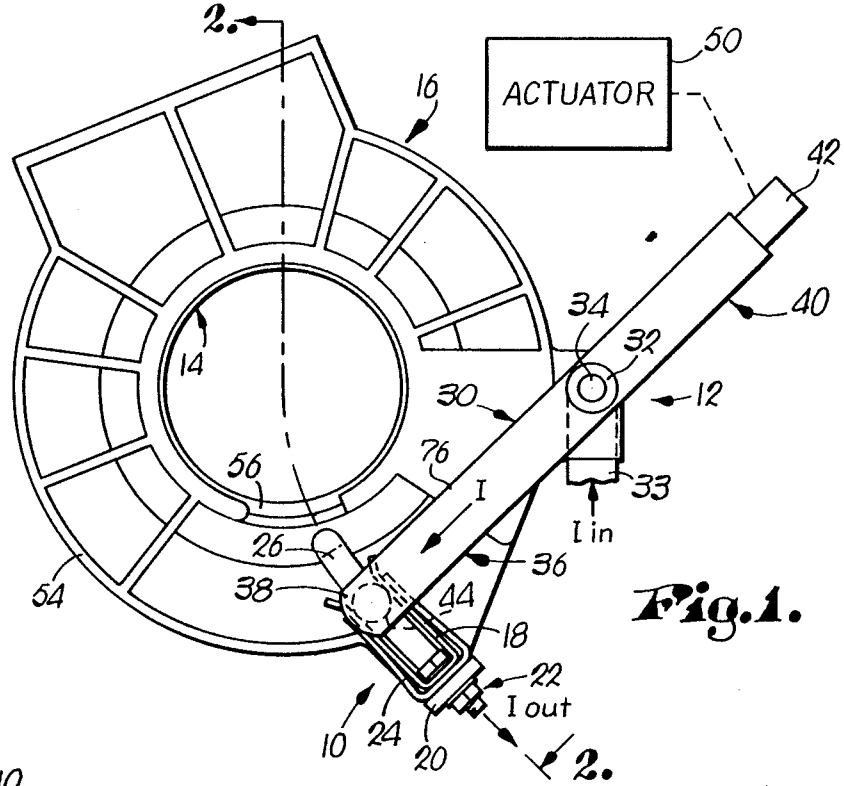
FIG. 1 is a plan view of an arc interrupter made in accordance with the present invention, wherein the movable contact is connected with the fixed contact.

An arc interrupter apparatus constructed in accordance with the present invention for use in electrical switch gear is illustrated in FIG. 1. Although not shown in the drawing, the apparatus is preferably disposed within a housing filled with an insulating gas having favorable arc extinguishing properties. For example, sulphur hexafluoride may desirably be employed as the insulating gas because of the many advantages offered by a gas of that type. Suphur hexafluoride is an inert, non-toxic, non-flammable gas that is an excellent dielectric. In addition, because the gas is electronegative, it is an excellent arc extinguishing material.

A pair of bushings preferably extend through the housing in a sealed manner and are adapted to be connected to the arc interruption apparatus shown in the figures. One of the bushings is adapted to be connected to a fixed contact of the apparatus while the other bushing is connected to a movable contact, so that the current path from a distribution line or the like includes the bushing and the fixed contact as well as the movable contact normally in engagement therewith.

In the apparatus itself, as shown in FIG. 1, the fixed contact 10 and movable contact 12 are mounted, together with a ring electrode 14, on a support 16 constructed of an insulating material such as an acetal or epoxy resin. The fixed contact 10 includes a generally U-shaped contact element 18 retained on a fixed contact arm 20 by any suitable means such as a bolt and nut arrangement 22. A U-shaped biasing element 24 is sandwiched between the contact element 18 and the contact arm 20 and includes two legs extending along the outer faces of the legs of the contact element 18. The legs of the biasing element 24 press inward against the legs of the contact element 18 in order to bias the legs of the contact element toward one another for retaining the movable contact 12 in engagement with the fixed contact 10 during normal current flow through the apparatus.

An L-shaped stationary arc tip 26 (FIGS. 2 and 4) is provided on the fixed contact 10 which is also mounted on the contact arm 20 by the bolt and nut assembly 22 and that extends beyond the legs of the contact element 18 by a predetermined distance. The stationary arc tip 26 is constructed of a resilient conductive metallic material having suitable arc resistent properties. The contact arm 20 is mounted on the support 16 by any suitable means such as by a further bolt and nut arrangement extending through the arm 20 and a wall 28 of the support 16.

Figure 4:
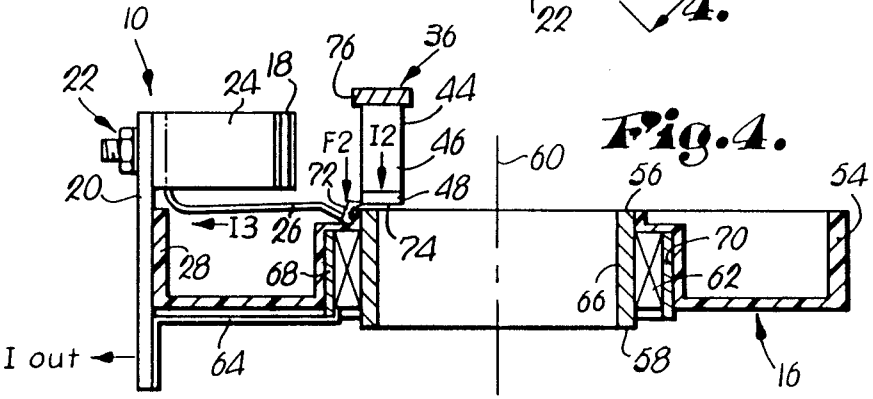
FIG. 4 is a cross-sectional side view of the interrupter of FIG. 3.

The movable contact 12 includes an elongated conductive member 30 having a hole 32 located intermediate the ends thereof through which a pivot pin 34 extends. The movable contact 12 is held in pressing engagement with a bus 33 by the pivot pin 34 which is spring-loaded to a predetermined force. The bus 33 connects with one of the bushings. The elongated member 30 includes a first arm section 36 extending between the hole 32 and one end 38 of the member 30 and a second arm section 40 extending from the hole 32 toward the other end 42 of the member 30. The first arm section 36 of the member 30 which is pivotal about the pivot axis defined by the central axis of the pivot pin 34, can be selectively engaged with the fixed contact 10 between the legs 18 thereof. First arm section 36 is preferably of L-shaped configuration and includes an angled portion 44 which extends toward the ring electrode 14 from the arm section 36 in a direction generally perpendicular to arm section 36 and parallel to the central longitudinal axis of the ring electrode 14. The angled portion 44 may either be formed of the same piece of material as arm section 36 or may be constructed of a separate piece of material. For example, as shown in FIG. 4, the angled portion 44 may be constructed of a first hollow cylindrical piece 46 and an arc-resistant end piece 48, both of which are adapted to be connected to the arm section 36 by a threaded shaft or the like extending axially through the angled portion 44.

The second arm section 40 serves as a lever through which an actuator 50 may act on the movable contact 12 to move such contact into and out of engagement with the fixed contact 10. During operation of the interrupter, as discussed in detail below, the actuator 50 pivots the elongated member 30 about its pivot axis along a path extending between the position shown in FIG. 1, with the movable and fixed contacts 12, 10 engaged with one another, and the position shown in FIG. 7, whereby the movable contact 12 is disposed at the central longitudinal axis of the ring electrode 14. Although the position at which the actuator 50 contacts the elongated member 30 of the movable contact 12 is illustrated as being at the end of the second arm section 40, it is noted that an alternative construction could include an elongated member which is connected to an actuator at a point along the first arm section intermediate the hole and the end of the member at which the angled portion is disposed.

The support 16 on which the contacts 10, 12 and the ring electrode 14 are mounted is of generally annular shape including an inner radial surface 52 which extends axially in a direction parallel to the pivot axis of the movable contact 12. The fixed contact 10 is mounted on an outer radial surface 54 of the support 16 at a position circumferentially spaced from the position at which the pivot pin 34 of the movable contact 12 is mounted such that the fixed contact 10 is separated from the pivot pin 34 of the movable contact 12 by a distance equal to the distance between the pivot pin 34 and the angled portion 44 of the movable contact 12. By constructing the apparatus in this manner, the angled portion 44 is received and retained by the legs of the fixed contact element 18 when the contacts 10, 12 are in engagement with one another. In order to further facilitate movement of the angled portion 44 into and out of engagement with the fixed contact element 18, the legs of the fixed contact element point in a direction generally tangent to the path of travel of the angled portion 44 of the movable contact 12.

The arc interrupting ring electrode 14 is disposed within the opening of the support 16 and includes opposed axial ends 56, 58 defining a central longitudinal axis 60 therebetween. The arc interrupting ring electrode 14 is formed of a conductive material such as copper and is of generally hollow cylindrical shape. One end 56 of the ring is closely surrounded by the insulating material of the support 16 which is flush with one end of the ring electrode 14 and extends radially outward therefrom to a point beneath the stationary arc tip 26 of the fixed contact 10. As discussed below with reference to the operation of the apparatus, this insulating material disposed between the fixed contact 10 and the ring electrode 14 serves two beneficial functions. Initially, as an arc forms between the movable contact 12 and the fixed contact 10 upon separation thereof, a magnetic force, described below, pushes the arc into contact with the insulating material thus cooling the arc and removing energy therefrom. In addition, when the arc contacts the insulating material, it somewhat ablates the material causing gases to be released which further aid in extinguishing the arc.

A field coil 62 surrounds the ring electrode 14 and is formed by a winding of conductive strip material, e.g., copper. In the embodiment illustrated in FIG. 1, the strip material is wrapped from the inside out around the ring electrode in a clockwise direction. The field coil 62 is in contact with the ring electrode 14 at the inner radial winding of the coil 62 and is electrically connected with the fixed contact 10 by a lead or busbar 64 extending between the outer winding of the coil 62 and the contact arm 20. Thus, the ring electrode 14 is connected through the field coil 62 to the fixed contact 10 such that the field coil 62 is maintained in an energized condition while current is flowing between the movable contact 12 and either the fixed contact 10 or the ring electrode 14. The direction of the winding of the field coil 62 is important in that the magnetic force created by current flow through the coil acts in the same direction as the direction in which the coil 62 wraps around the ring electrode 14. For example, because the winding extends in a clockwise direction in FIG. 1, the magnetic force created by the current flow through the coil 62 also acts in the clockwise direction on any arc extending inward from the ring electrode 14 at a right angle to an inner radial surface 66 thereof. Thus, at each point along the interior surface 66 of the ring electrode 14, an arc extending radially inward of the surface is pushed circumferentially along the surface in the direction of the winding, to cause spinning of the arc around the interior of the ring electrode 14.

A reinforcing ring 68 is disposed on the outer circumference of the field coil 62 and is fitted, along with the field coil into an annular stepped portion 70 of the inner radial surface 52 of the support 16. The reinforcing ring 68 is preferably constructed of steel to give mechanical rigidity to the ring electode 14 and field coil 62 and protect the field coil against damage. In addition, the steel ring 68 retains the coil winding within a tightly confined area thus enabling the coil winding to be easily fitted on the support once the winding has been assembled. The steel ring 68 also serves as a flux path for the magnetic field outside of the coil 62.

The operation of the arc interruption apparatus is depicted in the serial order of the drawing figures and includes the physical procedure of pivoting the movable contact 12 out of engagement with the fixed contact 10.

Figure 2:
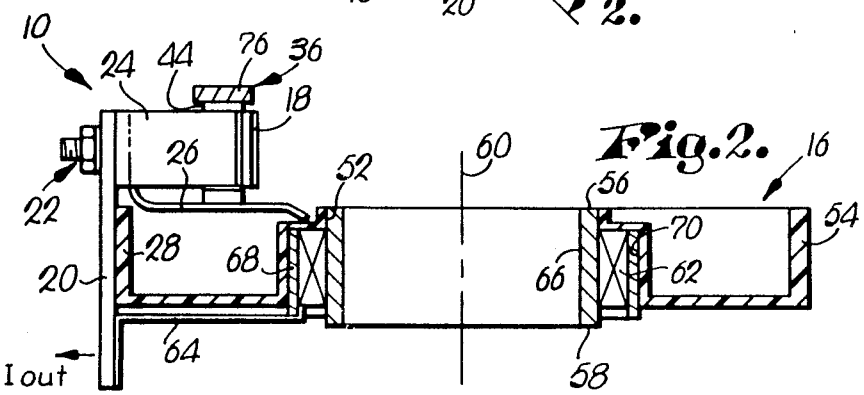
FIG. 2 is a cross-sectional side view of the interrupter of FIG. 1.
Figure 3:
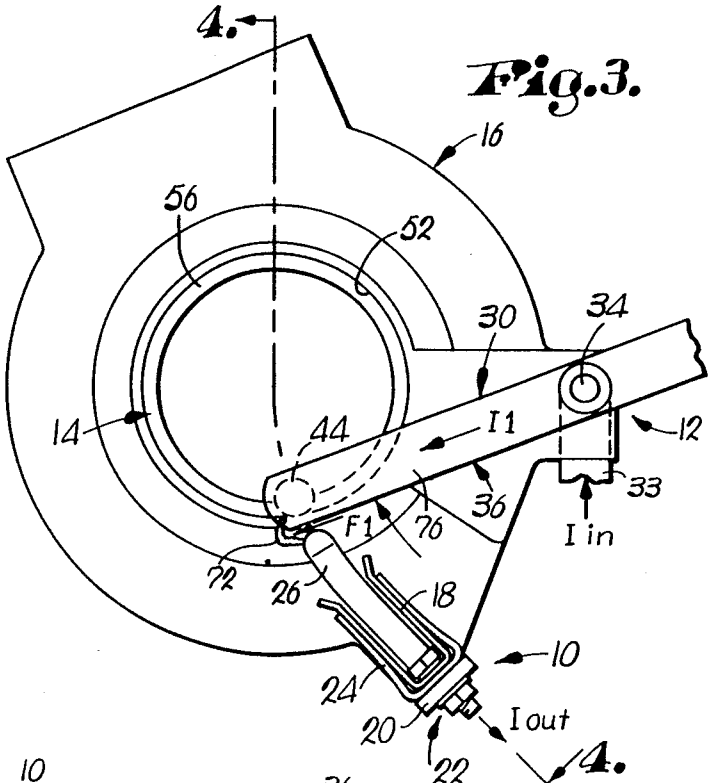
FIG. 3 is a plan view of the interrupter with the movable contact shown as being disconnected from the fixed contact and moving across the ring electrode.

As shown in FIGS. 1 and 2, during the time when the angled portion 44 of the movable contact 12 remains in engagement with the fixed contact 10, no arc forms therebetween. However, upon separation of the movable contact 12 from the stationary arc tip 26 of the fixed contact 10, an arc 72 forms between the tip 26 and an end 74 of the angled portion 44 of the movable contact remote from the main elongated segment 76 of the arm 36, as shown in FIGS. 3 and 4.

Once an arc 72 has formed between the contacts 10, 12 magnetic forces F1 and F2 immediately act on the arc forcing it to move both in a direction toward the ring electrode 14 and circumferentially of the electrode 14 in the direction of the winding of the field coil 62. For example, in a 15 kV power distribution system, if a fault current of 4000 amps is present when the arc interrupter is actuated, the force F1 would be approximately 0.03 Newtons while the force F2 would be about 0.93 Newtons. These forces are generated because of the configuration of the first arm 36 relative to the arc 72 and may be calculated by known methods. Because of the configuration of the first arm 36 of the elongated member 40, and the orientation of the arm relative to the arc formed between the arm and the fixed contact, the forces F1 and F2 act simultaneously to cause the arc to move in the desired direction.

The force F1 occurs as a result of the configuration of the first arm section 36 of the movable contact 12 which extends in a direction perpendicular to the direction in which the arc 72 would travel if no outside forces acted on the arc. Because of the angle of the first arm section 36, and the known behavior of an arc, which acts as a flexible current-carrying conductor, the arc is moved or bent in a direction tending to straighten the angle between the arc and the arm segment 76. This is attributable to reduction of the interaction of the magnetic fields created around the arm segment 76 and the arc by the flow of the current I1 therethrough. By virtue of the orientation of the arm section 36 relative to the fixed contact 10 and the ring electrode 14, the arc 72 is moved by the force F1 in the clockwise direction of the ring electrode 14, which is the same direction in which the force in the field coil 62 acts as discussed below. Therefore, the arc 72 begins to move in the eventual spinning direction thereof before it has physically commuted to the ring electrode 14 and before the force of the field coil 62 becomes effective on the arc.

Likewise, since the arc 72 is angled relative to the angled portion 44 of the arm 36, the arc wants to straighten out relative to the angled portion 44 under the influence of the force F2 created as a result of the interaction of the fields generated by the current I2 through the two conductors. As a result of this force F2, the arc is moved in a direction toward the ring electrode 14. Thus, immediately after the arc is formed, it is pushed toward and into contact with the insulating material of the support 16 resulting in cooling of the arc prior to transfer of the arc to the ring electrode 14. In addition, this second force F2 also pushes the arc toward the ring electrode 14 in order to force commutation of the arc to the ring electrode at an early time. The force F2 is substantially larger than the force F1 because of the separation which exists between the arc and the elongated segment 76 of the arm section 36 as opposed to the direct contact between the arc 72 and the angled portion 44.

Although the magnetic field of the coil 62 does not act on the arc during the period of movement of the movable contact 12 between the fixed contact 10 and the ring electrode 14, the arc is advantageously managed from the time it is created, by the forces F1 and F2 exerted on the arc as a result of the magnetic fields acting around the first arm section 36 of the movable contact 12. One benefit of such early management includes elongating the arc in the direction in which the arc will eventually spin once it commutes to the ring electrode 14. By providing this early elongation of the arc, the length of the arc path is increased and the arc material is dispersed into the insulating gas in the housing, thus resulting in an expedited quenching of the arc.

In addition, because the arc is forced against the cool insulating material of the support 16 by the force F2, energy is removed from the arc by the material even before the arc is able to commute to the ring electrode 14, and gases are released by the ablation of the insulating material. These gases further facilitate extinguishment of the arc. Furthermore, the force F1 urges the arc into contact with the ring electrode 14 as soon as the movable contact 12 passes across the electrode such that early commutation of the arc is promoted.

It is noted that in the preferred embodiment, the stationary arc tip 26 of the fixed contact 10 is radially separated from the ring electrode 14 by a relatively short distance. The advantage achieved by this construction resides in the presence of insulating material between the ring electrode 14 and the fixed contact 10 which absorbs energy from the arc 72 as the arc is pushed into the insulating material by the force F2. However, the radial spacing between the arc tip 26 and the ring electrode 14 may be varied within a range of spacing distances without detracting from several of the primary advantages realized by the present construction.

Figure 5:
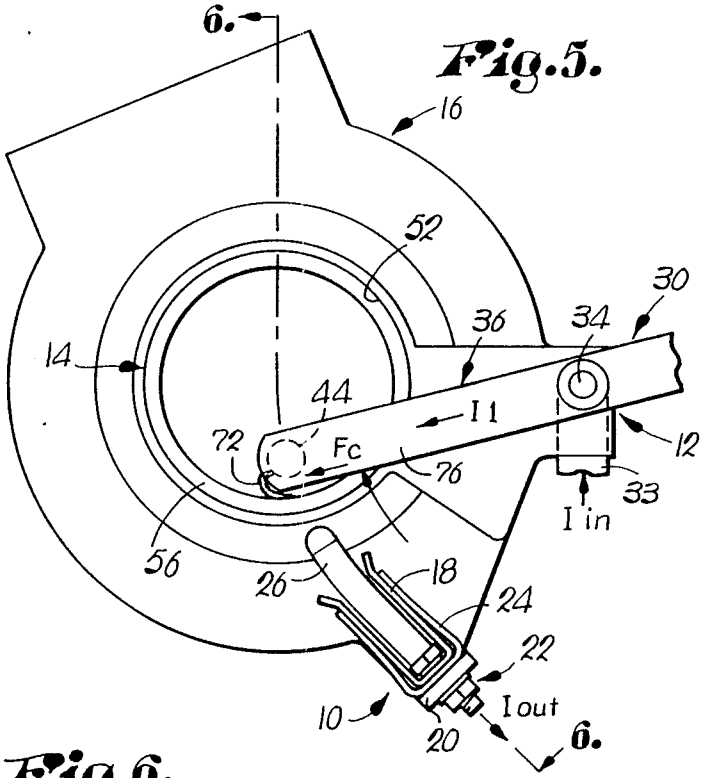
FIG. 5 is a plan view of the interrupter with the movable contact shown as being within the circumference of the ring electrode.

Once the arc 72 has commuted to the ring electrode 14, as shown in FIG. 5, the force F1 is strongly supplemented by the force Fc of the field coil 62 which acts within the hollow interior of the ring electrode in the same direction as F1. This force Fc is similar to the forces F1 and F2 in that the force Fc is caused by the interaction between the fields generated around the arc and coil winding during current flow therethrough. Because the arc acts as a flexible current carrying conductor, the arc, in attempting to straighten out the current path between the arc and the coil at each point along the circumference of the coil, moves circumferentially in the clockwise direction of the coil as shown in FIG. 5. However, because of the number of windings in the coil 62 and by virtue of the direct contact between the arc 72 and the ring electrode 14, the force Fc exerted on the arc by the coil 62 is many times greater than either of the forces F1 and F2.

Figure 6:
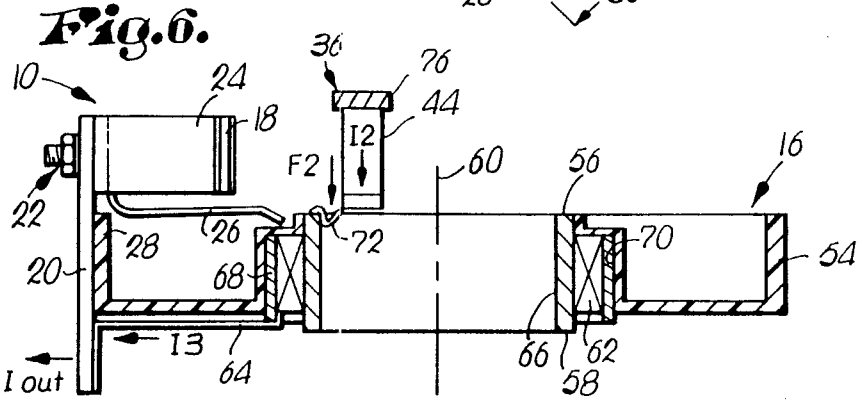
FIG. 6 is a cross-sectional side view of the interrupter of FIG. 5.

As shown in FIG. 6, the force F2 continues to act on the arc 72 after commutation of the arc to the ring electrode 14 as a result of the continued generally perpendicular relationship between the arc 72 and the angled portion 44 of the arm 36. This force F2 causes the arc to penetrate the first axial end 56 of the ring electrode 14 in such a way as to facilitate spinning of the arc by the force Fc. Thus, no mechanical movement of the movable contact 12 into the interior region defined by the ring electrode 14 is necessary, and it is possible to move the movable contact 12 along a path extending in a plane perpendicular to the central longitudinal axis 60 of the ring electrode 14 in such a way that the length of the path is longer and thus more advantageous than the path followed by the movable contact of known devices wherein the path followed by the movable contact extends physically into the interior region of the ring electrode.

Figure 7:
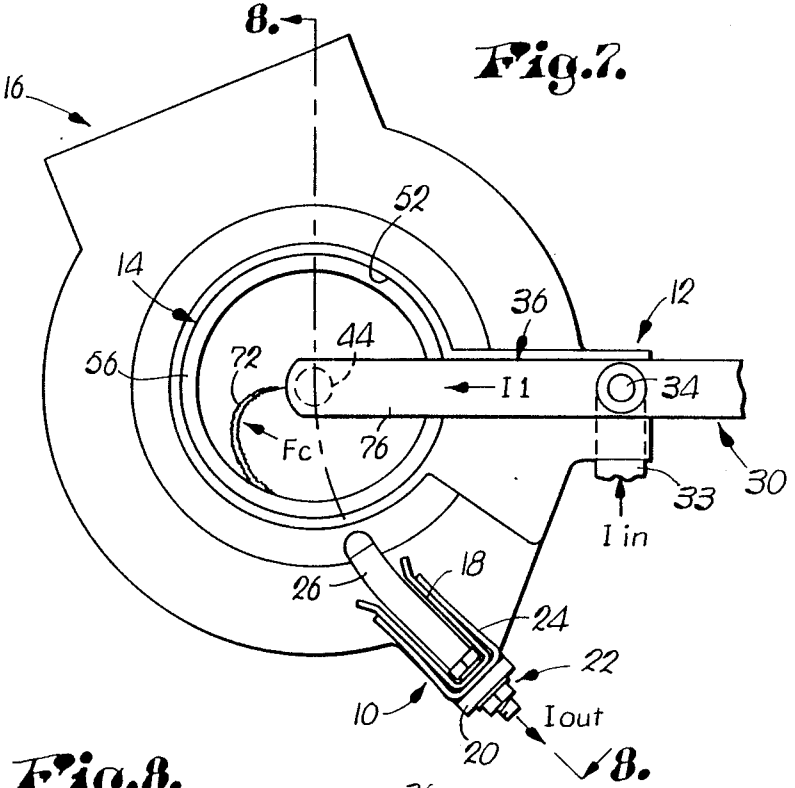
FIG. 7 is a plan view of the interrupter with the movable contact shown as being positioned at the central longitudinal axis.

In FIG. 7, the arm 36 of the movable contact 12 is shown as being disposed with the angled portion 44 positioned co-linear with the central longitudinal axis 60 of the ring electrode 14. At this stage of the arc interruption procedure, which preferably occurs no later than approximately 8 milliseconds after initiation of the fault interruption operation, it has been found that the arc will in most instances have already become extinguished. However, in order to more clearly explain the forces that act to extinguish the arc, the arc is illustrated as being in existence in the figure.

An understanding of the manner in which the arc is extinguished first requires comprehension of the way in which current passes through the arc interrupter apparatus once the arc has commuted to the ring electrode 14. The current, which is an alternating current, passes through the first arm section of the movable contact 12 and through the arc 72 into the ring electrode 14 where it is then conducted through the winding of the field coil 62. In the ring electrode 14, the phase of the magnetic field passing through the ring is shifted relative to the phase of the current passing through the arc 72. The thickness and conductivity of the ring electrode 14 may be varied in order to achieve a desired phase shift of between approximately 30 and 60 degrees, such that when the current in the arc 72 approaches zero during each half cycle, the magnetic field in the ring 14 is near its peak.

Because of this phase shift, the arc material continues to spin under the influence of the magnetic field in the ring even when the current through the arc approaches current zero such that when the ionized gas created by the arc and making up the arc material is spun into the arc extinguishing gas within the housing and deionized, the electronegative nature of the insulating gas quickly deionizes the arc and restores its dielectric strength, thus preventing reionization of the gas. The arc is thus precluded from being re-established.

Figure 8:
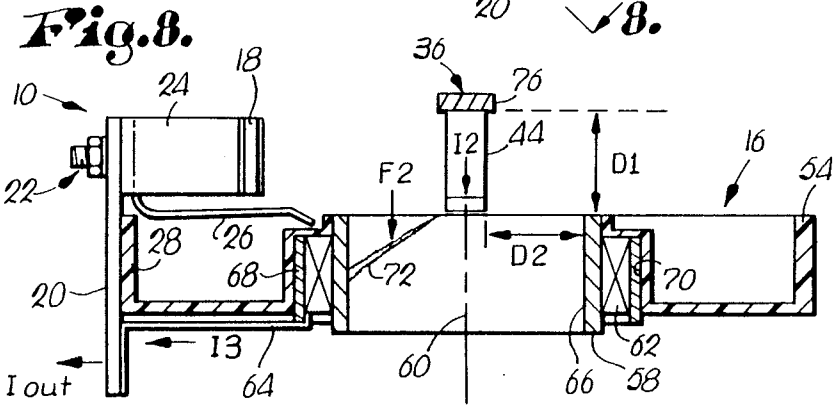
FIG. 8 is a cross-sectional side view of the interrupter of FIG. 7.

In order to ensure that no arc forms between the elongated segment 76 of the arm section 36 and the ring electrode 14, the angled portion 44 of the arm section 36 is disposed at a distance from the pivot axis of the movable contact 12 that is approximately equal to the separation distance between the pivot axis and the central longitudinal axis 60 of the ring electrode 14. Thus, the angled portion 44 of the first arm section 36 is co-linear with the central longitudinal axis 60 when the arm section 36 is in the position shown in FIGS. 7 and 8. In addition, the elongated portion 76 of the arm section 36 is axially displaced from the first axial end 56 of the electrode 14 by a distance D1 which must create a dielectric strength greater than the dielectric strength at D2 between the angled portion 44 and the ring electrode 14 at the central position of the arm shown in FIG. 8. In this manner, the dielectric strength between the ring electrode 14 and the first arm section 36 is greater than between the ring electrode 14 and the angled portion 44.

Numerous advantages are realized by constructing an arc interrupter apparatus in the manner described above and set forth in the claims. For example, by providing a construction as described, wherein an arc is managed and directed in a specific manner as set forth commencing with the instant of formation thereof, it is possible to extinguish arcs consistently within a shorter time period than heretofore possible. When such consistent operation can be assured, it is then possible to more easily design other switch gear components which rely on the timing of the arc interrupter in their own operation. Thus, the reliability of not only the arc interrupter, but also of the entire distribution or switching system is improved by employing an arc interrupter in accordance with the invention.

In addition, as mentioned above, because the force F2 acts to push an arc toward the ring electrode, it is permissible to leave a variable-sized gap between the first axial end of the ring electrode and the end 74 of the angled portion of the movable contact without significantly affecting the timing of the commutation of the arc from the fixed contact to the ring electrode. Thus, construction and assembly of the arc interrupter is simplified while overall consistency in operation of the device is improved.

It is of course possible to construct an arc interrupter in accordance with the present invention without departing from the scope of the invention as set forth in the claims. For example, although the movable contact is shown as being pivotally connected to the support in the figures, it is possible to move the movable contact between engaged and disengaged positions along any linear or arcuate path which extends in a direction perpendicular to the central longitudinal axis of the ring electrode so long as the orientation of the arm 36 relative to the arc remains substantially the same as that illustrated in the preferred embodiment, such that two forces act simultaneously on the arc in two directions.

What is claimed is:

1. Arc spinner interrupter apparatus comprising:

a first fixed electrical contact;

a ring electrode having first and second axial ends and defining a central longitudinal axis;

a field coil surrounding the ring electrode;

means for electrically coupling the ring electrode to the fixed electrical contact through the field coil so that a magnetic field is created within the ring electrode during current flow through the field coil; and a second electrical contact having an arm section which is selectively movable along a path in a plane perpendicular to the central longitudinal axis of the electrode into disposition engaging the fixed contact, the arm section being of generally L-shaped configuration presenting a first angled portion that extends in a direction parallel to the central longitudinal axis, the fixed electrical contact being disposed radially outward of the ring electrode adjacent the first end of the ring electrode in a position such that the arm section of the movable contact moves toward the central longitudinal axis of the electrode when disconnected from the fixed electrical contact, wherein, upon separation of the second contact from the fixed contact causing an arc to be formed, the generally L-shaped arm section of the second contact constructed and arranged to cause a first electromagnetic force to be exerted on the arc which acts in the direction toward the ring electrode and to cause a second electromagnetic force to be simultaneously exerted on the arc which acts in a circumferential direction relative to the central longitudinal axis.

2. The arc interrupter apparatus according to claim 1, wherein the arm section of the second electrical contact is mounted for pivotal movement about a pivot axis extending in a direction parallel to the central longitudinal axis of the ring electrode.

3. The arc interrupter apparatus according to claim 1, wherein is provided mounting means for supporting the fixed electrical contact, the ring electrode, the field coil and the second electrical contact respectively, said mounting means further including insulating means for insulating the fixed electrical contact, ring electrode and field coil from the second electrical contact when the second contact is disconnected from the fixed contact.

4. The arc interrupter apparatus according to claim 1, further comprising insulating material disposed radially outward of the first axial end of the ring electrode between the ring electrode and the fixed electrical contact, the insulating material being positioned within the path of the arc upon formation thereof so that energy is removed from the arc during movement of the second electrical contact away from the fixed contact.

5. The arc interrupter apparatus according to claim 4, wherein the insulating material is selected from the group consisting of thermoplastic acetal resin, epoxy resin and any combination thereof.

6. The arc interrupter apparatus according to claim 1, wherein the arm section of the second electrical contact includes an elongated portion that extends generally in a plane perpendicular to the central longitudinal axis.

7. The arc interrupter apparatus according to claim 1, further comprising actuating means for effecting selective movement of the movable contact into and out of engagement with the fixed contact.

8. The arc interrupter apparatus according to claim 7, wherein the second electrical contact includes a second arm section that is disposed generally in a plane perpendicular to the central longitudinal axis, the actuating means engaging the second arm section.

9. The arc interrupter apparatus according to claim 1, further comprising a hollow cylindrical support ring in close surrounding engagement with the field coil.

10. Arc spinner apparatus for interrupting a high voltage electrical current, the apparatus comprising:

a fixed electrical contact;

a movable electrical contact having an arm section selectively engageable with the fixed contact, an arc being generated when the movable contact in an energized condition is disconnected from the fixed contact;

an arc interrupting ring electrode associated with the contacts and having opposed ends defining a central longitudinal axis therebetween;

a field coil surrounding the ring electrode; and means for electrically connecting the field coil to the fixed contact so that when the movable contact is disconnected from the fixed contact and an arc is formed between the movable contact and the ring electrode, the field coil is maintained in an energized condition, the arm section of the movable contact including an angled portion projecting from the arm section toward the electrode in a direction generally parallel to the longitudinal axis of the electrode, the arm section being movable across the electrode along a path perpendicular to and toward the longitudinal axis of the electrode when the movable contact is shifted to interrupt current flow through the contacts, the arm section being located in disposition relative to the arc causing simultaneous first and second electromagnetic forces to be exerted on the arc upon disconnection of the contacts as the angled portion approaches the electrode and then moves across the electrode, the first electromagnetic force acting in a direction toward the ring electrode and the second electromagnetic force acting in a circumferential direction relative to the central axis of the electrode to enhance spinning and therefor extinguishment of the arc.

11. The arc interrupter apparatus according to claim 10, wherein the arm section of the movable contact is mounted for pivotal movement about a pivot axis extending in a direction parallel to the central longitudinal axis of the ring electrode.

12. The arc interrupter apparatus according to claim 10, wherein is provided mounting means for supporting the fixed electrical contact, the ring electrode, the field coil and the movable contact, the mounting means further including insulating means for insulating the fixed contact, ring electrode and field coil from the second electrical contact when the second contact is disconnected from the fixed contact.

13. The arc interrupter apparatus according to claim 10, further comprising insulating material disposed radially outward of one of the ends of the ring electrode between the ring electrode and the fixed electrical contact, the insulating material being positioned within the path of the arc upon formation thereof so as to remove some of the energy from the arc during movement of the movable contact away from the fixed contact.

14. The arc interrupter apparatus according to claim 13, wherein the insulating material is selected from the group consisting of thermoplastic acetal resin, epoxy resin and combinations thereof.

15. The arc interrupter apparatus according to claim 10, wherein the arm section of the second electrical contact includes an elongated portion that extends in a plane perpendicular to the central longitudinal axis.

16. The arc interrupter apparatus according to claim 10, further comprising actuating means for effecting selective movement of the arm section of the movable contact into and out of engagement with the fixed contact.

17. The arc interrupter apparatus according to claim 16, wherein the movable contact further includes a second arm section which is contacted by the actuating means.

18. A method of interrupting an arc forming between a movable electrical contact and a fixed electrical contact upon separation of the movable contact from the fixed contact, the fixed electrical contact being in electrical communication with a ring electrode through a field coil arranged in series between the fixed contact and the ring electrode, the ring electrode defining a central longitudinal axis, the method comprising the step of:

managing the arc substantially immediately upon formation of the arc by exerting a first electromagnetic force on the arc which acts in a direction toward the ring electrode and simultaneously exerting a second electro magnetic force on the arc which acts in a circumferential direction relative to the central longitudinal axis, the second electromagnetic force causing the arc to elongate in the direction of eventual spin before transfer of the arc to the ring electrode is initiated.

19. A method of interrupting an arc as set forth in claim 18, wherein the arc management includes the step of forcing the current flowing through the movable contact to describe essentially a right angle path of travel immediately adjacent the ring electrode and field coil when the movable contact is moved into disposition adjacent the electrode.

* * * * *